US006636005B2

(12) United States Patent
Wacyk et al.

(10) Patent No.: US 6,636,005 B2
(45) Date of Patent: Oct. 21, 2003

(54) ARCHITECTURE OF BALLAST WITH INTEGRATED RF INTERFACE

(75) Inventors: Ihor Terence Wacyk, Briarcliff Manor, NY (US); Ling Wang, Millwood, NY (US); Johannes Hendrik Wessels, Mierlo (NL)

(73) Assignee: Koninklijke Philips Eletronics N.V., Eindhoven (NL)

( * ) Notice: Subject to any disclaimer, the term of this patent is extended or adjusted under 35 U.S.C. 154(b) by 0 days.

(21) Appl. No.: 09/991,082

(22) Filed: Nov. 14, 2001

(65) Prior Publication Data

US 2003/0090889 A1 May 15, 2003

(51) Int. Cl.[7] ..... G05F 1/00

(52) U.S. Cl. ..... 315/291; 315/DIG. 4; 315/149; 315/294

(58) Field of Search ..... 315/DIG. 4, 149, 315/158, 291, 292, 293, 294, 295, 320, 322

(56) References Cited

U.S. PATENT DOCUMENTS 5,463,286 A 10/1995 D'Aleo et al.
5,489,827 A 2/1996 Xia
5,544,037 A 8/1996 Luger
5,559,395 A * 9/1996 Ve nKitasubrahmanian et al. .. 315/247
5,637,964 A 6/1997 Hakkarainen
5,680,017 A * 10/1997 Veldman et al. ..... 315/308
5,726,644 A 3/1998 Jednacz
6,119,076 A 9/2000 Williams
6,169,377 B1 1/2001 Bryde et al.
6,310,440 B1 * 10/2001 Lansing et al. ..... 315/149
6,393,608 B1 * 5/2002 Pulford et al. ..... 1/16

FOREIGN PATENT DOCUMENTS

WO WO0076034 12/2000 ..... H01R/33/945

* cited by examiner

*Primary Examiner*—Tho Phan

(57) ABSTRACT

The invention is a new architecture for a high frequency (HF) ballast with wireless communication interface. The new architecture integrates the RF wireless interface into the ballast. A user control transmits an RF control signal to a second antenna at the ballast site which provides the RF signal to the ballast which activates the fluorescent lamp. The ballast includes a transceiver/receiver, a communication decoder, a power control stage and a power stage. The transceiver/receiver receives the RF signal and communicates it to the communication decoder which acts as an interface to the power stage control. The power stage control controls the power stage that activates the fluorescent lamp. The communication decoder, power control stage, power stage and transceiver/receiver are located within the ballast enclosure which is an important part of the invention. If the power stage control is digital it may be combined with the communication decoder into one microprocessor or digital controller such as an ASIC. The communication decoder may be a serial interface. The transceiver/receiver is an RF integrated circuit. The ballast further includes an isolator to isolate the transceiver/receiver from the first antenna. The isolator may be capacitive.

26 Claims, 10 Drawing Sheets

ARCHITECTURE OF BALLAST WITH INTEGRATED RF INTERFACE

BACKGROUND OF INVENTION

1. Field of the Invention

The invention relates to a ballast architecture with wireless communication for activating a fluorescent lamp. More specifically, the invention relates to a ballast which includes a communication decoder, a lamp driver and a transceiver/receiver within the ballast enclosure.

2. Description of the Related Art

Lighting control in an office or commercial building has gone through several stages. The traditional control approach uses a separate control box outside the ballast, as shown in FIG. 1. The central control management for the whole building can also control the lighting through the network.

With the recent advancements in RF and semiconductor technology, wireless control is attracting more and more attention from people in the lighting industry. Currently there are some wireless control systems available in the market. A typical RF wireless control structure is shown in FIG. 2. As can be seen in the figure, the wires between the wall unit and the control box in FIG. 1 are replaced by a transmitter and receiver. This eliminates the vertical wiring and brings wireless advantages. However, the control box is still outside of the ballast.

An additional problem with prior art RF systems is isolation. For safety reasons, when the RF receiver/transceiver is wired to the ballast, there has to be some interface for high voltage isolation. This adds cost and complexity to the whole system. FIG. 3 shows the problem. The current state of the art uses a transformer or opto-isolation. FIG. 3 also shows the structure of the ballast. The digital decoder is used to decode the control command coming from the control box, it can be a microprocessor. The lamp driver consists of the power stage and the control IC. The power stage includes the high voltage driver, protection circuits, power storage and filter elements. The state-of-the-art for the control IC is the Alpha-based analog IC for controlling the power stage. Reference for Alpha IC is U.S. Pat. Nos. 5,680,017 and 5,559,395.

The current approach of lighting control faces the following challenges:

1. Cost: adding a separate box connected to the ballast increases the cost.

2. Power savings: if the power consumption information can be fed back from ballasts, the central management can easily improve the energy utilization. However, with the analog ballast, it is not easy to build a two-way communication link without extra cost.

3. Resolving the high voltage isolation problem described previously.

SUMMARY OF THE INVENTION

The invention is a new architecture for a high frequency (HF) ballast with wireless communication interface. The new architecture integrates the RF wireless interface into the ballast. A user control transmits an RF control signal to a second antenna at the ballast site which provides the RF signal to the ballast which activates the fluorescent lamp. The ballast includes a transceiver/receiver, a communication decoder, a power control stage and a power stage. The transceiver/receiver receives the RF signal and communicates it to the communication decoder which acts as an interface to the power stage control. The power stage control controls the power stage that activates the fluorescent lamp. The communication decoder, power stage control (analog or digital), power stage and transceiver/receiver are located within the ballast enclosure which is an important part of the invention. If the power stage control is digital it may be combined with the communication decoder into one microprocessor. The communication decoder may be a serial interface. The transceiver/receiver is an RF integrated circuit. The ballast further includes an isolator to isolate the transceiver/receiver from the second antenna. The isolator may be capacitive.

DETAILED DESCRIPTION OF THE INVENTION

Figure 1:
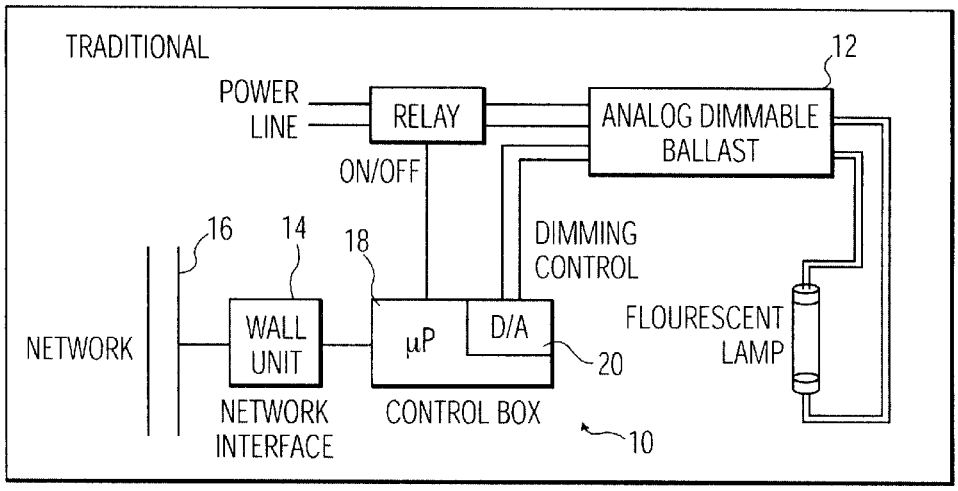
FIG. 1 (PRIOR ART)
FIG. 1 is a prior art traditional control approach using a separate control box outside the ballast.

FIG. 1 is a prior art traditional control approach using a separate control box outside the ballast. The control box 10 is wired to one or more ballasts 12. It is also connected with a wall unit 14 that acts as a network interface to communicate with the central control manager for the whole building through the wired network 16 as shown in FIG. 1. The control box 10 normally has a microcontroller 18 with a digital to analog converter (DAC) 20 inside. It can turn on/off and dim the ballast for fluorescent (TL) lamps. The central control management for the whole building can also control the lighting through the network.

Figure 2:
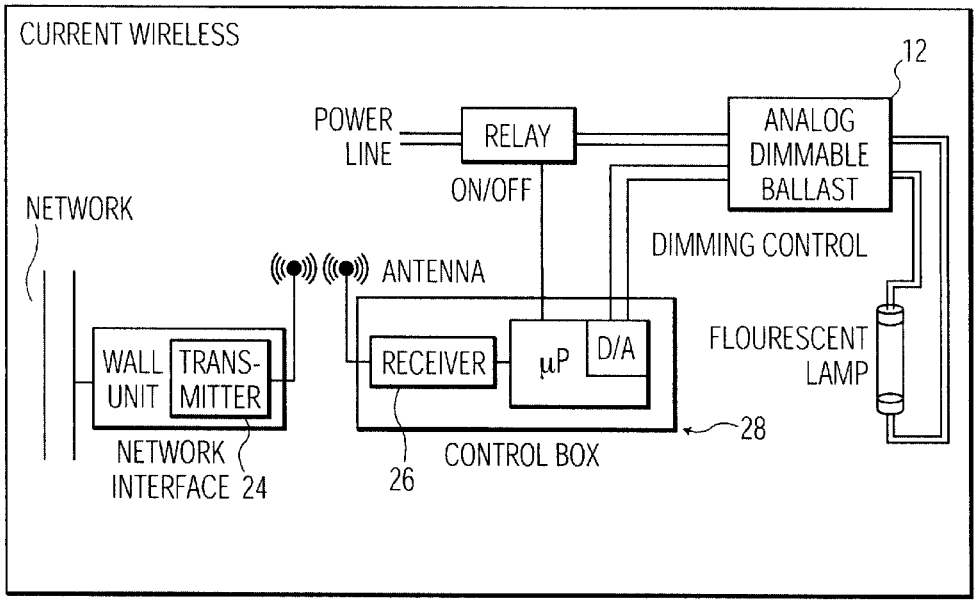
FIG. 2 (PRIOR ART)
FIG. 2 shows a typical prior art RF wireless control structure.

In FIG. 2, the wires between the wall unit 14 and the control box 10 in FIG. 1 are replaced by a transmitter 24 and receiver 26. This eliminates the vertical wiring and brings wireless advantages. However, the control box 28 is still outside of ballast 12.

Figure 3:
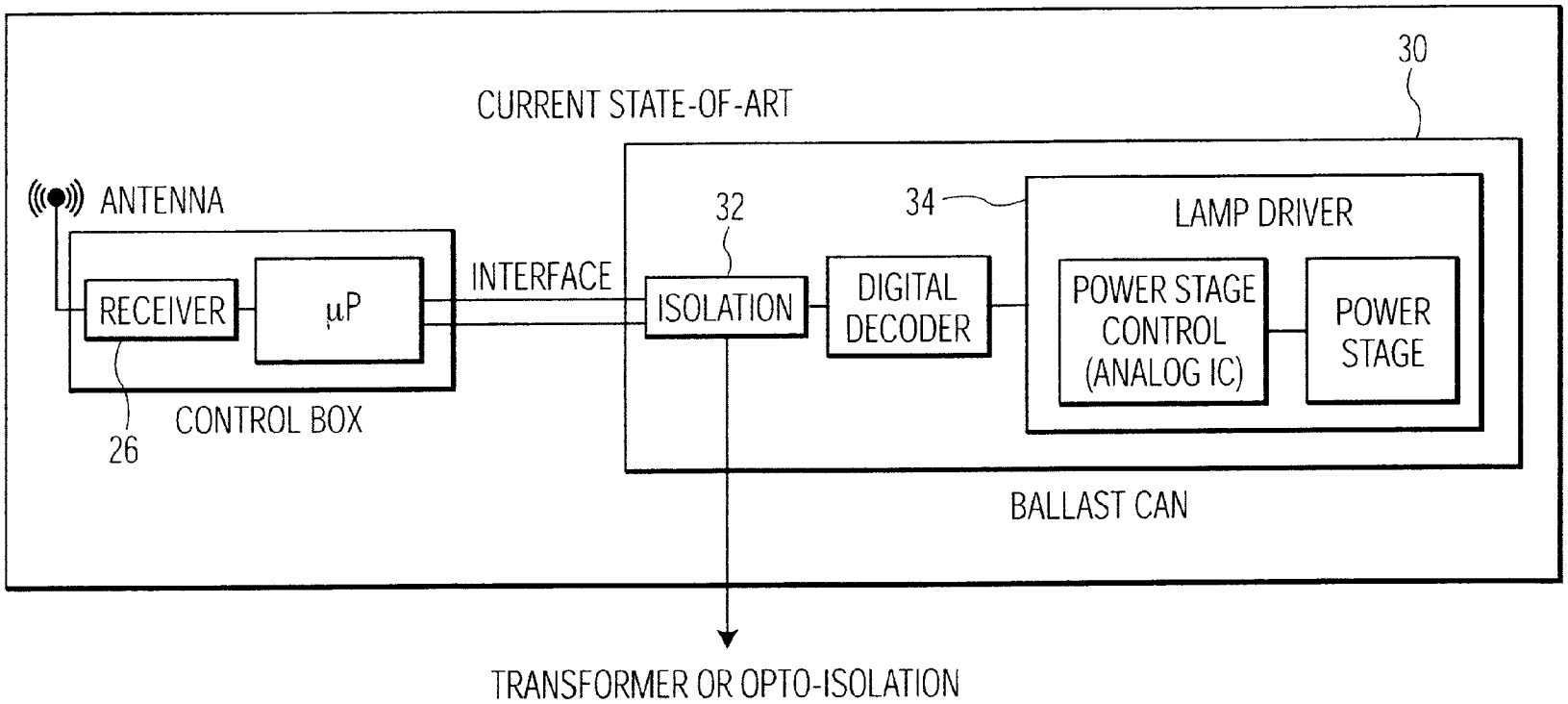
FIG. 3 (PRIOR ART)
FIG. 3 shows a prior art RF wireless system with isolation.

FIG. 3 shows an additional problem of isolation with current state of the art RF wireless systems. For safety reasons, in FIG. 3 when the control box 28 containing RF receiver 26 is wired to the ballast 30, there has to be some interface for high voltage isolation from lamp driver 34. The isolation comes from the use of a transformer or opto-isolation 32 as the signals go through the interface as low frequency digital signals. This adds cost and complexity to the whole system.

Figure 4:
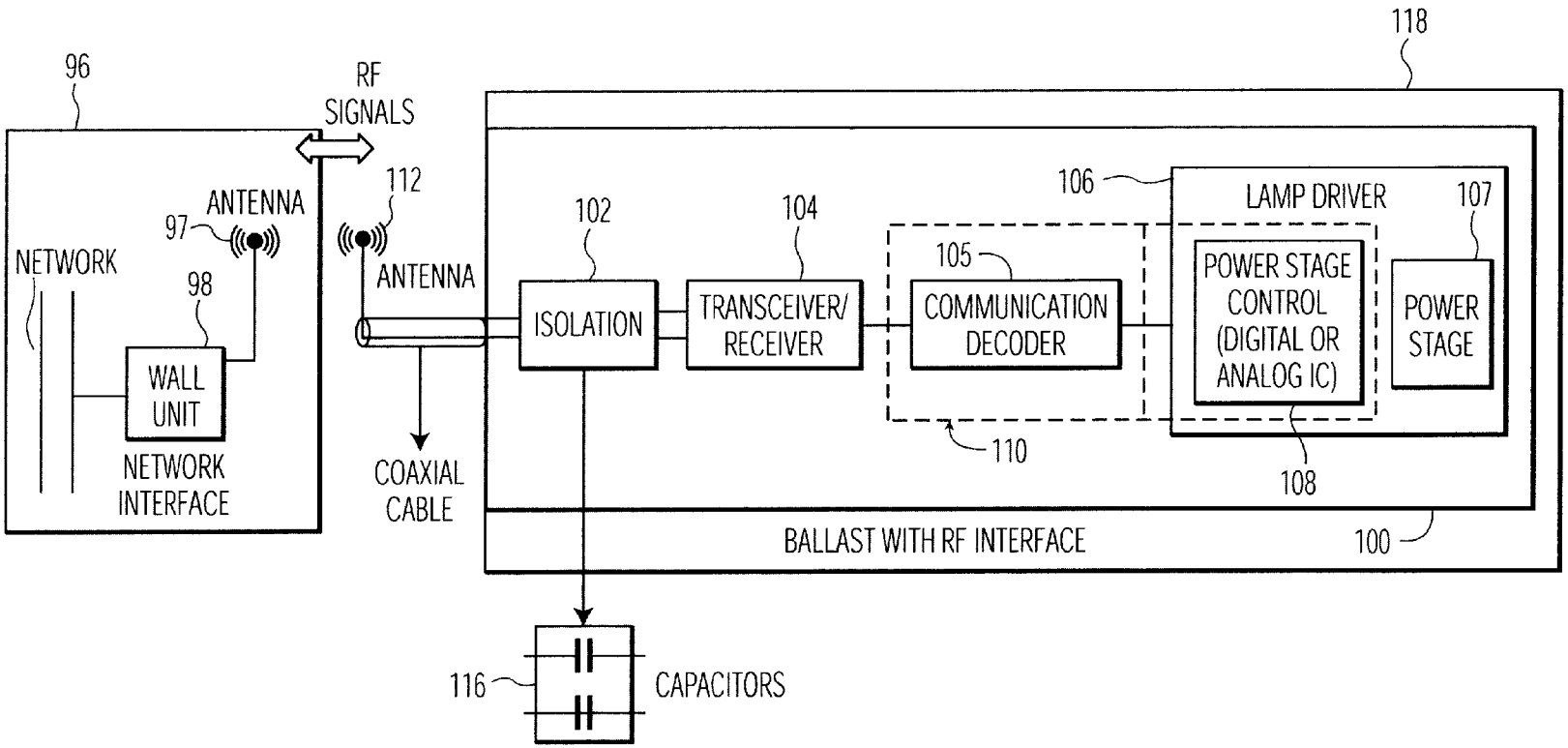
FIG. 4 shows a new inventive architecture for high frequency (HF) digital ballast with wireless communication interface.
Figure 10:
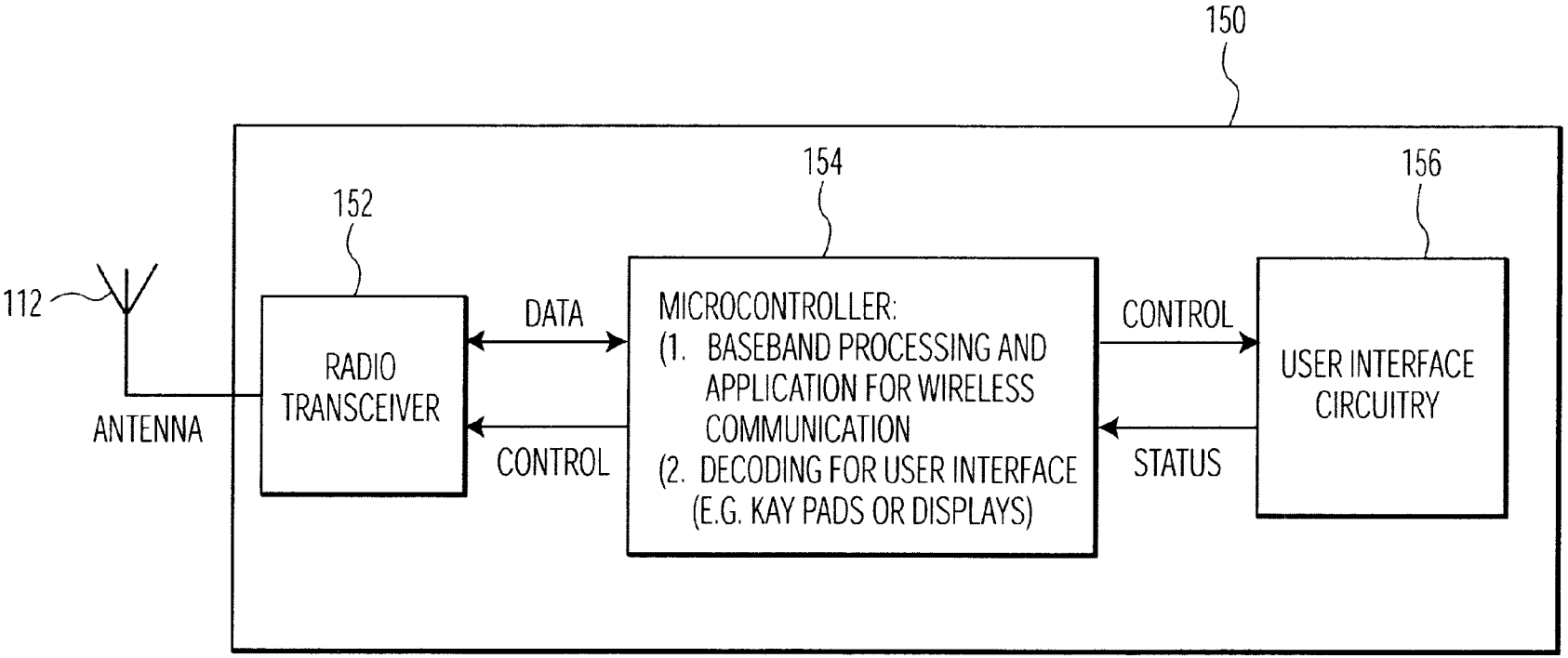
FIG. 10 is a functional block diagram of a handheld remote control for the inventive architecture of FIG. 4.

FIG. 4 shows a new inventive architecture for a high frequency (HF) ballast with wireless communication interface. RF signals are transmitted from a user control 96 having a first antenna 97 to a second antenna 112 in the new architecture. User control 96 may include a wall unit 98 and first antenna 97 or a handheld remote control 150 (FIG. 10). The new architecture integrates the RF wireless interface into the ballast 100. The ballast consists of an isolator 102, a transceiver/receiver 104 which is an RF integrated circuit (IC), a communication decoder 105 and a lamp driver 106. The lamp driver consists of power stage 107 and power stage control IC 108. The communication decoder 105 is digital. The power stage control IC 108 can be a digital or analog IC. If a digital power stage control IC is used, the communication decoder 105 and the digital power stage control IC 108 can be combined into one digital controller 110 such as a microprocessor or an ASIC. If the power stage control 108 is analog, then it is separate from communication decoder 105. They may be on separate IC's or they could be combined on a mixed signal ASIC. The communication decoder 105 may be a serial interface. Digital controller 110 may be a digital controller such as a, P6LV IC, developed at Philips Research USA in Briarcliff Manor, N.Y., or any other microcontroller that has the required peripherals such as ADC and PWM, or the resources that allow the users to build these peripherals by themselves. Second antenna 112 needs to be isolated from the rest of the circuit, therefore, isolator 102 provides isolation between second antenna 112 and transceiver/receiver 104. Isolator 102 may be a capacitive network 116 made up of a pair of capacitors. The isolation can be built with a simple capacitive network since the signals are at Radio Frequency. In addition, in the case that a plastic enclosure is used for a ballast and the antenna does not have to stick outside of the ballast can, this isolation can be avoided. This is in contrast to the previously referred to prior art where the transceiver/receiver is outside the ballast and is hardwired to the ballast. In that case there needs to be high voltage isolation between the ballast and the transceiver/receiver which adds complexity and cost.

Transceiver/receiver 104 is used as a front end to modulate/demodulate baseband signals. It interfaces with digital controller 110, through communication decoder 105. Since communication decoder 105 and power stage control IC 108 (if digital) can be combined into one microprocessor instead of two separate microprocessors, this eliminates any extra components. The P6LV IC is a 8051-based dedicated microcontroller designed for lighting. It not only has the capability of a standard 8051 microcontroller, but also the peripherals needed for controlling the lamp gear. Another alternative, the P8XC51 microcontroller is also from the 8051 family. The baseband signals coming out of the transceiver/receiver 104 are processed by the digital controller IC 110 and provided to power stage 107 having a high voltage output to energize a fluorescent lamp.

The new architecture has the following features: All the modules for control are in one ballast box 118. No separate control box is needed. This results in significant cost reduction. In addition, with wireless control, the cost of wiring is eliminated and makes it a much better solution for retrofit market. Also because the communication decoder and power stage control (or digital controller 110) are in the ballast, more control features can be implemented, such as binding a group of lamps into one remote controller. The communication can also be made bi-directional. The information on the lamp operation, such as the power consumption, can be fed back in real-time. This leads to effective power utilization and savings. In addition, the isolation 102 can be built with a simple capacitive network since the signals that go through are high frequency. With the RF section 104 inside the ballast, the isolation interface can be much simplified.

Figure 4A:
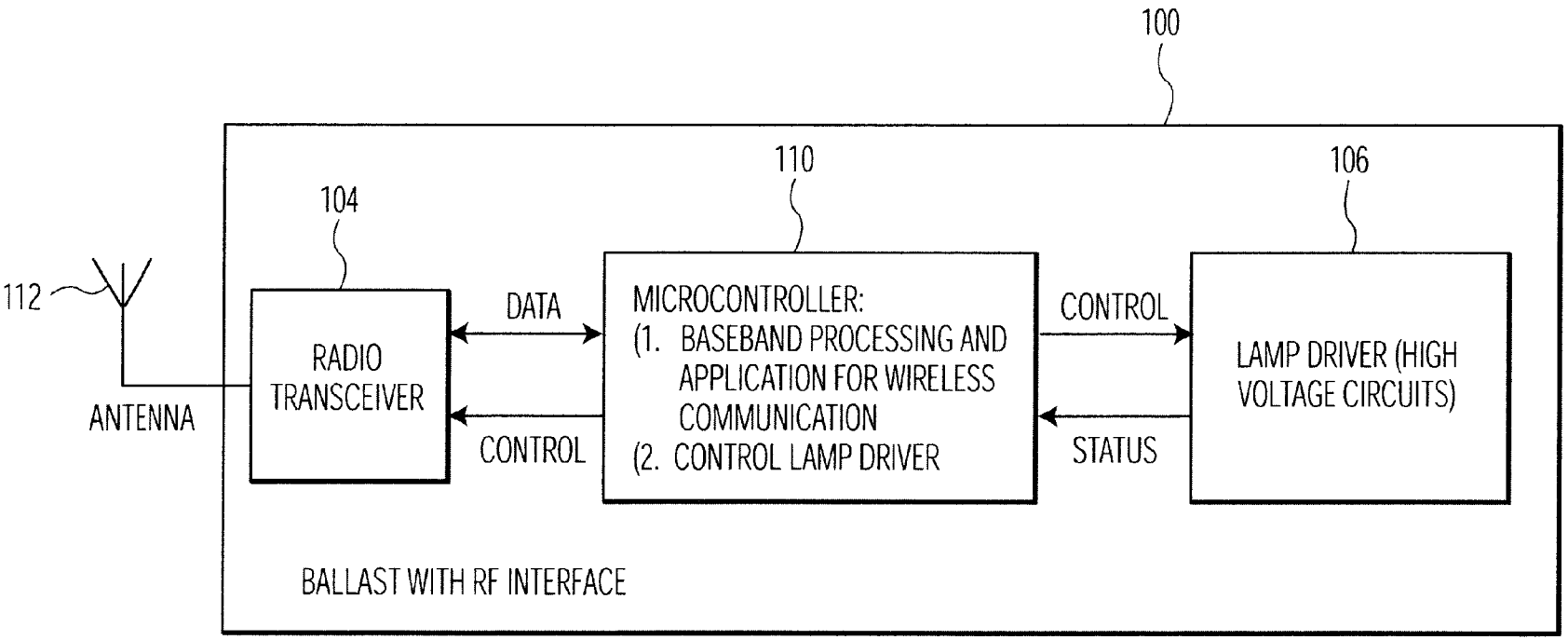
FIG. 4*a* shows a block diagram of the operation of the inventive architecture of FIG. 4.

FIG. 4*a* shows a block diagram of the operation of FIG. 4. The operational block diagram of FIG. 4*a* contains three sections: Radio transceiver 104, microcontroller 110 and lamp driver 106. Radio transceiver 104 receives/transmits data from second antenna 112 through the air interface. In the receiving mode, it passes the demodulated data to the microcontroller 110 for processing. In the transmitting mode, it modulates the data from the microcontroller 110 and passes on the data to the second antenna 112 and the air interface. Microcontroller 110 controls the radio and does the baseband processing. On top of the communication protocol, it also contains the application program that tells the ballast to operate the lamp in a certain way. The other responsibility for the microcontroller 110 is to control the lamp driver 106, which drives the high voltage stage of the ballast. The high voltage portion is directly connected to the lamps (not shown).

Figure 5:
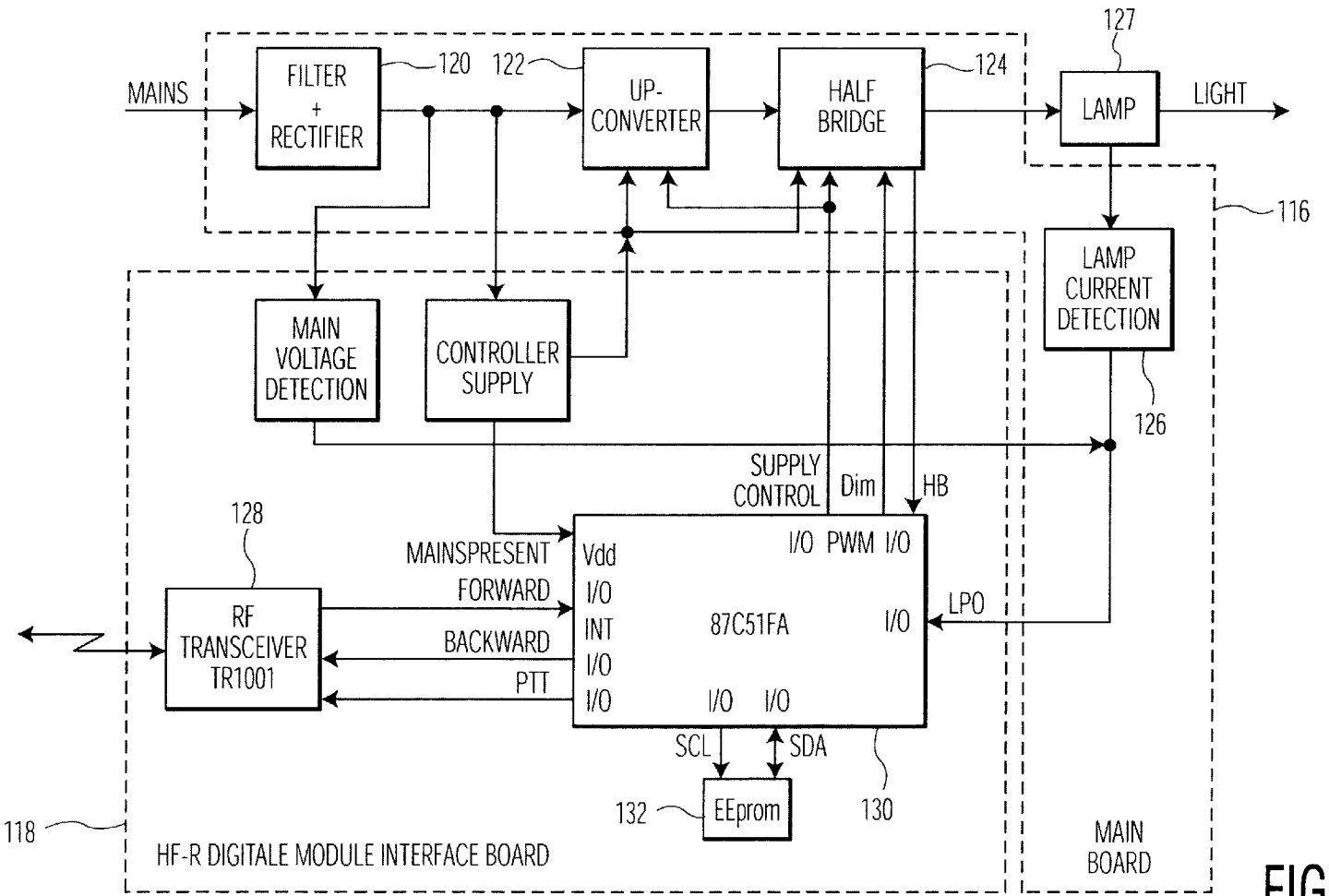
FIG. 5 shows a functional block diagram of a working implementation of the inventive ballast with an integrated RF interface.

FIG. 5 shows a functional block diagram of the implementation of a digital addressable ballast with RF interface. It contains two boards, the main board 116 and the RF interface board 118. The main board 116 contains the lamp driver 106 (from FIG. 4) which includes filter and rectifier 120, up-converter 122, half-bridge 124 and lamp current detection circuit 126. The output of half bridge rectifier 124 goes to fluorescent lamp 127. The interface board 118, HF-R digital module, is composed of RF transceiver 128, a microprocessor 130 and an EEPROM 132.

Figure 6:
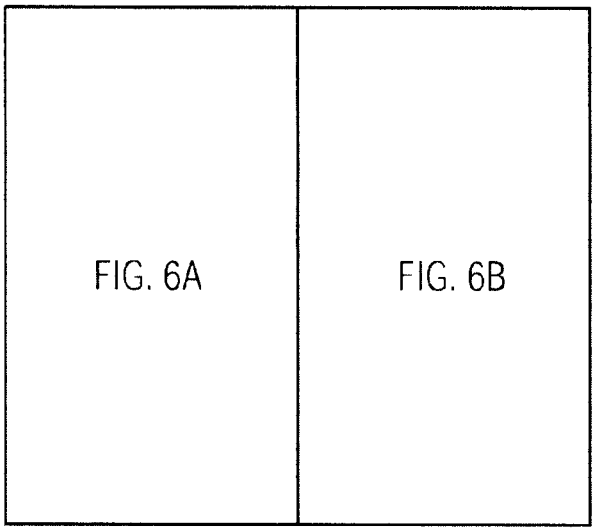
FIG. 6 shows a detailed schematic diagram of the working implementation of FIG. 5.
Figure 6A:
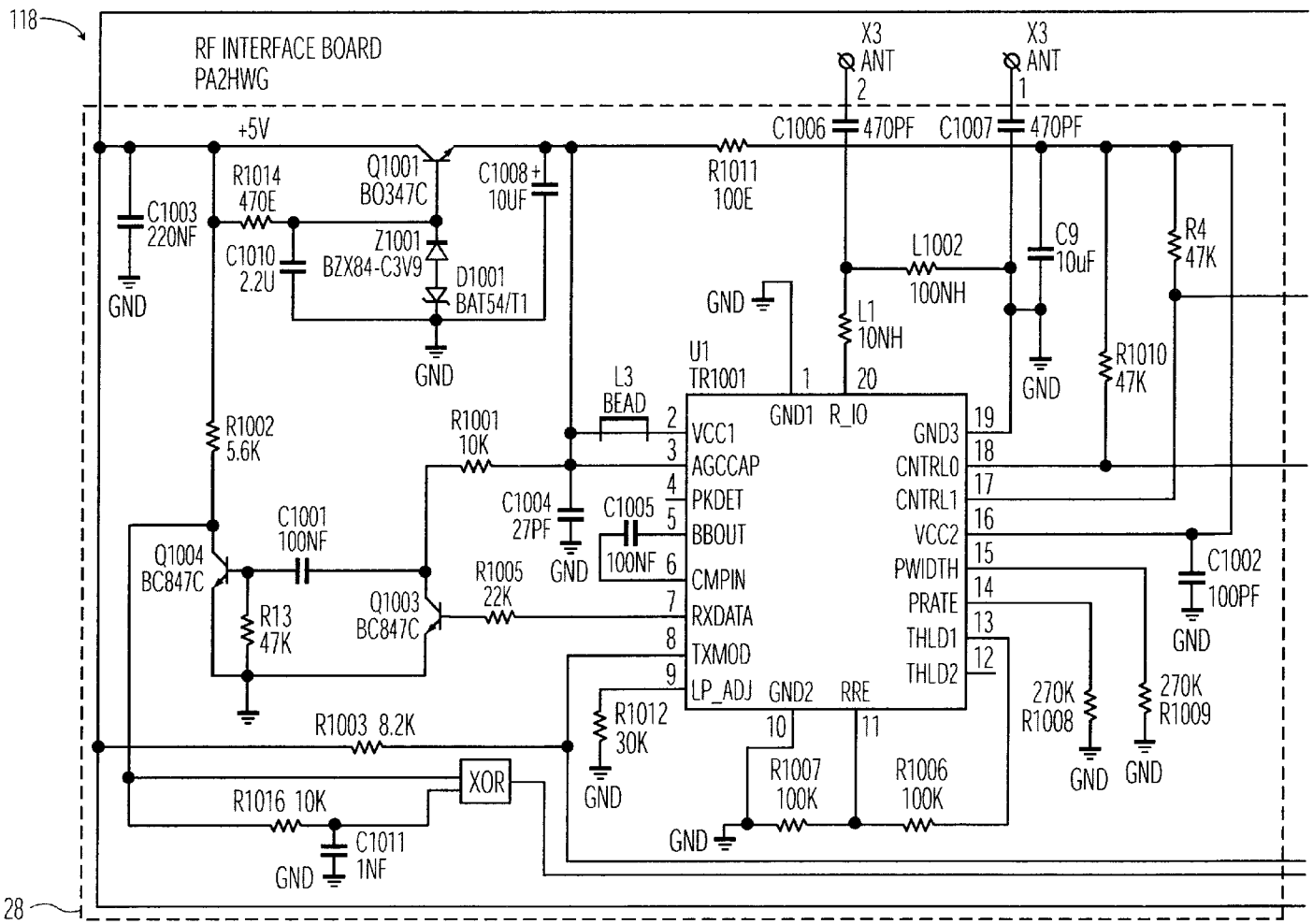
Figure 6B:
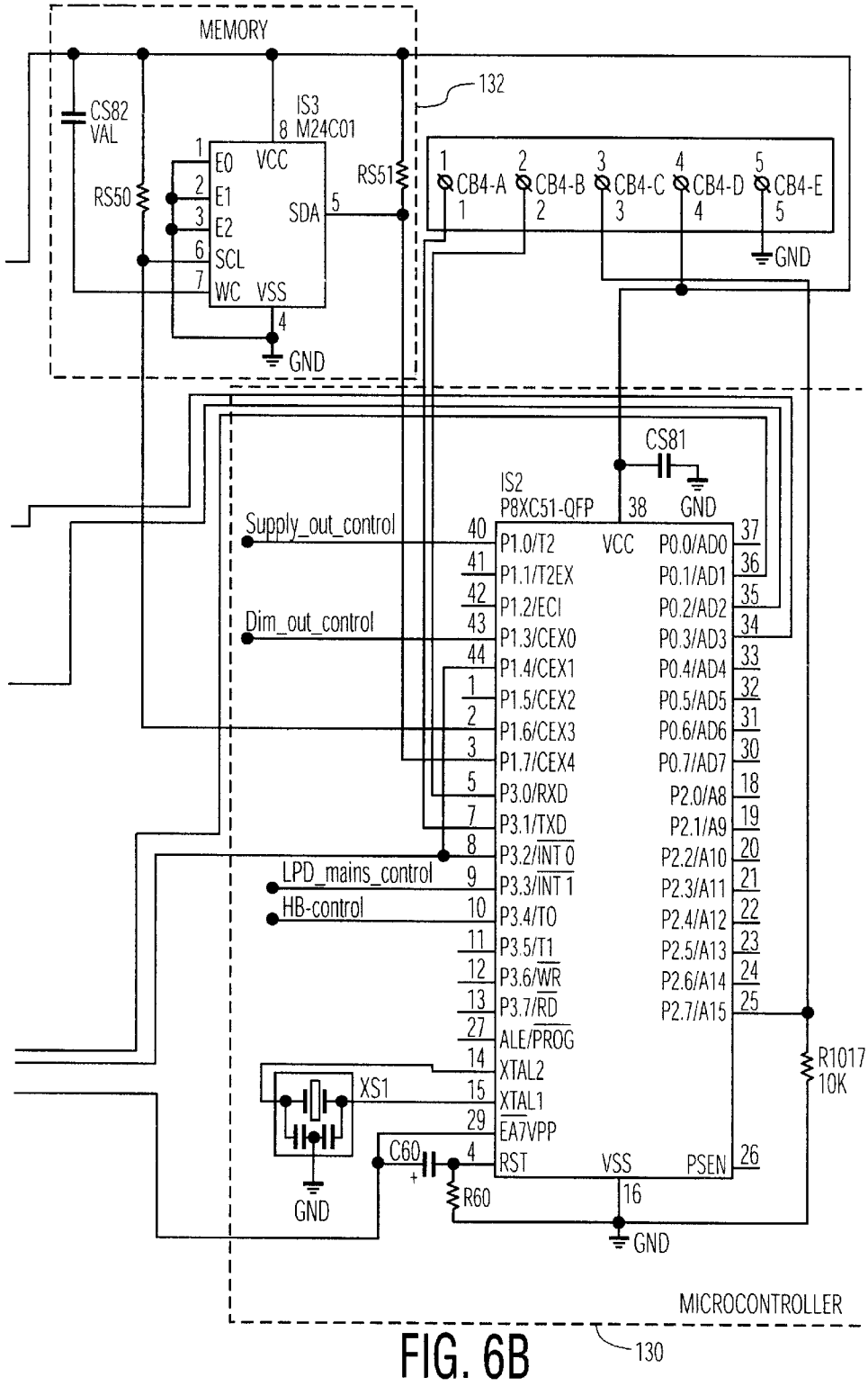

FIG. 6 shows the detailed schematic and block diagram of the implementation of the interface between the RF transceiver 128 and the ballast controller 130. As seen in the figure, U1 (TR1001) is the radio transceiver 128 by RF Monolithics, and IS2 (P8XC51-QFP) is the microcontroller 130 by Philips Semiconductors which serves as the ballast controller and controls the RF transceiver 128. The control signals from microcontroller 130 (pin 9, 10, 40, and 43) also go to the lamp driver 106 that is not shown in the figure. A memory 132 used for microcontroller 130 is also shown. The antenna is set at ANT1 and ANT2 that are connected to the R_IO pin of the transceiver (U1).

Figure 7:
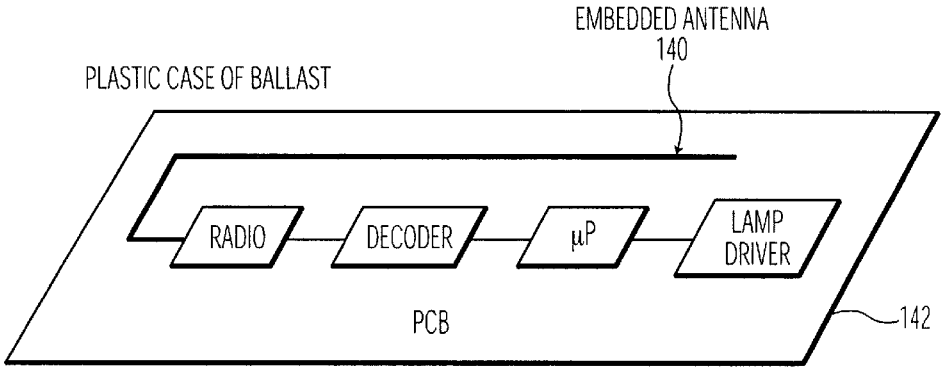
FIG. 7 shows an embedded antenna on a printed circuit board.
Figure 8:
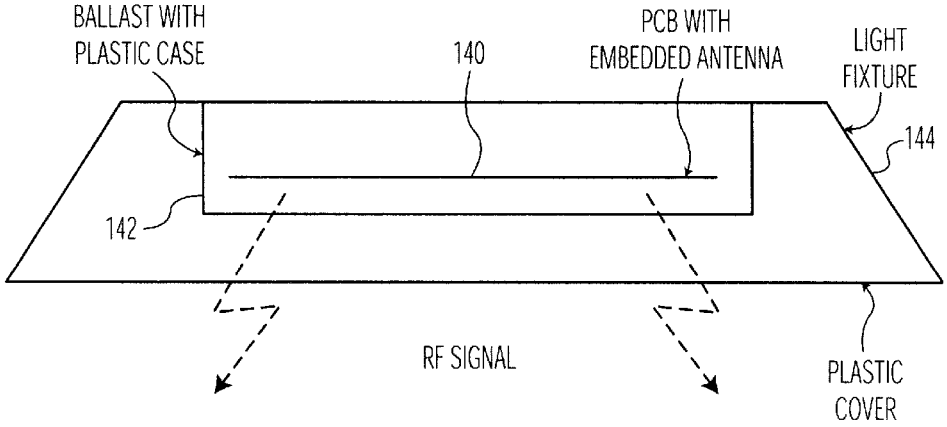
FIG. 8 shows how RF signals travel through the plastic ballast case and plastic light fixture cover.
Figure 9:
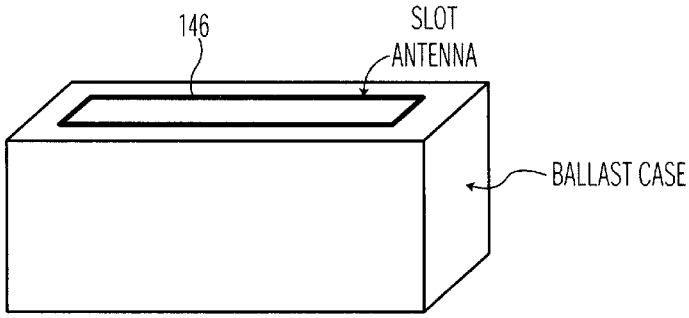
FIG. 9 is a half wavelength slot antenna for a metal cased ballast.

For the ballast with integrated RF interface, one important issue is how to get the radiation outside the ballast. There are several ways to design the antenna. FIG. 7 shows the embedded antenna 140, which is a metal trace put on the printed circuit board (PCB) 142. This works because the RF signals go through the plastic case 144 of ballast 100 and the plastic cover 144 of the light fixture, as shown in FIG. 8. Another option is a halfwavelength slot antenna 146 shown in FIG. 9. This is a solution for metal cased ballast.

The proposed ballast with RF interface can be used together with a handheld remote control in a wireless lighting control system. The handheld remote control should contain the same RF transceiver and communicate with the ballast using a wireless communication protocol the same as user control 96 in FIG. 4. FIG. 10 shows the block diagram of the remote control 150. It consists of the RF transceiver 152, a microprocessor 154 or other type of digital control IC, and a user interface 156 such as key pads for user request in and certain type of display (e.g. LEDs) to give indications of the operating status.

While the preferred embodiments of the invention have been shown and described, numerous variations and alternative embodiments will occur to those skilled in the art. Accordingly, it is intended that the invention be limited only in terms of the appended claims.

We claim:

1. An RF wireless architecture for activating a fluorescent lamp, the RF wireless architecture including a second antenna which receives an RF control signal and provides it to a ballast, the ballast comprising, a power stage providing a high voltage signal to activate said fluorescent lamp, a power control stage for controlling said power stage, a communication decoder acting as an interface to said power stage control a transceiver/receiver receiving said RF control signal and providing said RF control signal to said communication decoder; said communication decoder, said power stage control, said power stage and said transceiver/receiver located within said ballast.

2. The apparatus of claim 1 in which said communication decoder is a serial interface.

3. The apparatus of claim 1 in which said transceiver/receiver is an RF integrated circuit.

4. The apparatus of claim 1 in which said ballast further includes an isolator circuit to isolate said transceiver/receiver from said second antenna.

5. The apparatus of claim 4 in which said isolator circuit is capacitive.

6. The apparatus of claim 1 including a user control which transmits an RF control signal from a first antenna to said second antenna.

7. The apparatus of claim 6 in which said communication decoder is a serial interface.

8. The apparatus of claim 6 in which said transceiver/receiver is an RF intergrated circuit.

9. The apparatus of claim 6 in which said ballast further includes an isolator circuit to isolate said transceiver/receiver from said second antenna.

10. The apparatus of claim 9 in which said isolator circuit is capacitive.

11. The apparatus of claim 1 in which said RF transceiver/receiver, said communication decoder, said power stage control and said power stage are integrated into one single IC.

12. An RF wireless architecture for activating a fluorescent lamp, the RF wireless architecture including a second antenna which receives an RF control signal and provides it to a ballast, the ballast comprising, a power stage providing a high voltage signal to activate said fluorescent lamp, a digital controller for controlling said power stage, a transceiver/receiver receiving said RF control signal and providing said RF control signal to said digital controller; said digital controller, said power stage and said transceiver/receiver located within said ballast.

13. The apparatus of claim 12 in which said digital controller has a communication decoder and a digital power stage control, said communication decoder communicating with said transceiver/receiver and acting as an interface to said power stage control.

14. The apparatus of claim 13 in which said communication decoder is a serial interface.

15. The apparatus of claim 14 in which said transceiver/receiver is an RF integrated circuit.

16. The apparatus of claim 15 in which said ballast further includes an isolator circuit to isolate said transceiver/receiver from said second antenna.

17. The apparatus of claim 16 in which said isolator circuit is capacitive.

18. The apparatus of claim 13 in which said digital controller is integrated into one single IC.

19. The apparatus of claim 12 including a user control which transmits an RF control signal from a first antenna to said second antenna.

20. An RF wireless architecture for activating a fluorescent lamp, the RF wireless architecture including a second antenna which receives an RF control signal and provides it to a ballast, the ballast comprising, a lamp driver for providing an activating signal to said fluorescent lamp, a communication decoder, acting as an interface to said lamp driver, a transceiver/receiver communicating with said communication decoder for receiving said RF control signal and providing said RF control signal to said communication decoder; said communication decoder, said lamp driver and said transceiver/receiver located within said ballast.

21. The RF wireless architecture of claim 20 in which said lamp driver has a power stage control and a power stage, said power stage control receiving the output of said communication decoder and providing a control signal to said power stage to activate said fluorescent lamp.

22. The apparatus of claim 21 in which said communication decoder is a serial interface.

23. The apparatus of claim 21 in which said transceiver/receiver is an RF integrated circuit.

24. The apparatus of claim 21 in which said ballast further includes an isolator circuit to isolate said transceiver/receiver from said second antenna.

25. The apparatus of claim 24 in which said isolator circuit is capacitive.

26. The apparatus of claim 20 including a user control which transmits an RF control signal from a first antenna to said second antenna.

* * * * *